US005993587A

United States Patent [19]

Seki et al.

[11] Patent Number: 5,993,587

[45] Date of Patent: Nov. 30, 1999

[54] DOUBLE FACER WITH THREADING MEANS

[75] Inventors: Yukuharu Seki; Toshihide Kato; Tadayuki Kumagai, all of Hiroshima-ken, Japan

[73] Assignee: Mitsubishi Heavy Industries, Ltd., Tokyo, Japan

[21] Appl. No.: 09/022,494

[22] Filed: Feb. 12, 1998

[30] Foreign Application Priority Data

Mar. 7, 1997 [JP] Japan ..... 9-053088

[51] Int. Cl.[6] ..... B31F 1/20

[52] U.S. Cl. ..... 156/210; 156/205; 156/470; 493/463

[58] Field of Search ..... 156/470, 205, 156/210, 583.5; 493/463; 226/91, 92; 100/151, 153, 154

[56] References Cited

U.S. PATENT DOCUMENTS

| | | | |
|---|---|---|---|
| 3,616,073 | 10/1971 | McGirr | 156/470 |
| 3,712,843 | 1/1973 | Gartaganis et al. . | |
| 3,963,161 | 6/1976 | Jerney et al. . | |
| 4,580,710 | 4/1986 | Ledgerwood | 226/141 |
| 5,456,783 | 10/1995 | Sissons | 156/470 X |
| 5,466,329 | 11/1995 | Marachke . | |
| 5,526,739 | 6/1996 | Lauderbaugh et al. . | |
| 5,732,622 | 3/1998 | Lauderbaugh | 156/470 X |

FOREIGN PATENT DOCUMENTS

| | | | |
|---|---|---|---|
| 0 077 186 A2 | 4/1983 | European Pat. Off. . | |
| 0 409 510 A1 | 1/1991 | European Pat. Off. . | |
| 0 566 842 A1 | 10/1993 | European Pat. Off. . | |
| 0 623 459 A2 | 11/1994 | European Pat. Off. . | |
| 0 750 986 A2 | 1/1997 | European Pat. Off. . | |
| 35 30 630 A1 | 3/1987 | Germany . | |
| 195 06 778 A1 | 8/1996 | Germany . | |
| 6-328596 | 11/1994 | Japan . | |
| 8-174722 | 7/1996 | Japan . | |
| 2 299 543 | 10/1996 | United Kingdom . | |
| 2321652 | 8/1998 | United Kingdom | 156/470 |
| 9847699 | 10/1998 | WIPO | 156/470 |

*Primary Examiner*—Jeff H. Aftergut
*Attorney, Agent, or Firm*—Armstrong, Westerman, Hattori, McLeland and Naughton

[57] ABSTRACT

This invention relates to a double facer of a corrugating machine which aims to improve a drying state or bonding state between a single-faced corrugated fiberboard sheet and a liner and improve the quality of a corrugated fiberboard sheet. In a double facer for bonding together a single-faced corrugated fiberboard sheet and a liner to form a corrugated fiberboard sheet, provided are a heating member disposed along a conveying direction of the corrugated fiberboard sheet; a pressing unit, disposed so as to oppose the heating member, for pushing the corrugated fiberboard sheet against the heating member; a sheet conveying unit, disposed downstream the heating member, for conveying the corrugated fiberboard sheet; and a sheet feeding unit for feeding the corrugated fiberboard sheet toward the sheet conveying unit; while the pressing unit comprises a plurality of pressing devices disposed in series as being separated from each other along the conveying direction of the corrugated fiberboard sheet.

17 Claims, 10 Drawing Sheets

DOUBLE FACER WITH THREADING MEANS

BACKGROUND OF THE INVENTION

1. Field of the Invention

This invention relates to a double facer installed in a corrugating machine which bonds a single-faced corrugated fiberboard sheet and a liner together so as to manufacture a corrugated paper.

2. Description of Related Art

Conventionally known is a corrugating machine (apparatus for making corrugated fiberboard sheet) which bonds a single-faced corrugated fiberboard sheet and a liner together to make a corrugated paper (i.e., double-faced corrugated fiberboard sheet, double wall corrugated fiberboard sheet, triple wall corrugated fiberboard sheet, or multi wall corrugated fiberboard sheet formed by a larger number of layers; hereinafter referred to as corrugated fiberboard sheet).

Such a corrugating machine is constituted by a single facer, a double facer, a slitter scorer, a cutoff, a stacker, and the like. The single facer forms a single-faced corrugated fiberboard sheet, the double facer bonds the single-faced corrugated fiberboard sheet and a liner together to form a corrugated fiberboard sheet, and then thus formed corrugated fiberboard sheet is cut by the slitter scorer and cutoff into divided-plate-like corrugated fiberboard sheets, which are piled up in the stacker.

The double facer installed in such a corrugating machine will further be explained. FIG. 9 is a schematic side view showing an overall configuration of the double facer installed in the corrugating machine.

As shown in the schematic side view of FIG. 9, a double facer 100 installed in the corrugating machine bonds together a single-faced corrugated fiberboard sheet 1, which has been formed by a non-depicted single facer disposed upstream the double facer 100 (on the left side of FIG. 9) and whose flute leading edge has been provided with a glue at a glue machine 102, and a liner (bottom liner) 3, which has been conveyed from a non-depicted mill roll stand, thereby forming a corrugated fiberboard sheet 4. Here, depicted in FIG. 9 is the double facer 100 for forming a double-faced corrugated fiberboard sheet as the corrugated fiberboard sheet.

To this end, as shown in FIG. 9, the double facer 100 comprises a hot plate (heating box) 105 for heating the single-faced corrugated fiberboard sheet 1 and the liner 3 and causing the glue to gel and dry; an upper conveyor belt 106 for conveying the single-faced corrugated fiberboard sheet 1 and the liner 3; a plurality of press rolls 110 for pressing the single-faced corrugated fiberboard sheet 1 and the liner 3; and a lower conveyor belt 111 for conveying the single-faced corrugated fiberboard sheet 1 and liner 3 (yielding the double-faced corrugated fiberboard sheet 4 after being bonded together) while holding them between the upper conveyor belt 106 and the lower conveyor belt 111; thereby heating the single-faced corrugated fiberboard sheet 1 and the liner 3 while pressing them, and bonding them together to form the corrugated fiberboard sheet 4.

Here, the hot plate 105 is constituted by a plate-like member which is appropriately heated by steam, and is disposed at a lower part on the upstream side of the double facer 100.

The upper conveyor belt 106 is wound around two drums 107 and 108, while the drum 107 is driven by a non-depicted driving unit, whereby the upper conveyor belt 106 is driven to rotate. The upper conveyor belt 106 is provided with a belt-stretching unit 109 constituted by two rollers, thus yielding an appropriate tension.

The upper conveyor belt 106 is disposed at the upper part of the double facer 100 so as to convey the single-faced corrugated fiberboard sheet 1 and liner 3 (yielding the corrugated fiberboard sheet 4 after being bonded together) while holding them between the hot plate 105 and the lower conveyor belt 111, which will be explained later in detail.

Also, as shown in the schematic side view of FIG. 9, the press rolls 110 are used for yielding a pressing force required for bonding the single-faced corrugated fiberboard sheet 1 and the liner 3 together, and are arranged in series with each other along the sheet conveying direction, while each of which is constituted as a rodlike member extending over the widthwise direction of the corrugated fiberboard sheet 4. These press rolls 110 press the back face of the upper conveyor belt 106, thereby pressing the single-faced corrugated fiberboard sheet 1 and the liner 3 against the hot plate 105 disposed thereunder.

The lower conveyor belt 111 is disposed at a lower part on the downstream side of the upper conveyor belt 106, and conveys the corrugated fiberboard sheet 4 while holding it between the upper conveyor belt 106 and lower conveyor belt 111. In this case, a conveying force greater than the friction resistance occurring between the corrugated fiberboard sheet 4 and the hot plate 105 acts on the corrugated fiberboard sheet 4, whereby the corrugated fiberboard sheet 4 is pulled downstream.

As a result of such a configuration, the double facer 100 of the corrugating machine operates as follows.

Namely, the single-faced corrugated fiberboard sheet 1 formed by the non-depicted single facer is provided with a glue at its flute leading edge by the glue machine 102, and then is fed into the space between the hot plate 105, which is appropriately heated by steam, and the upper conveyor belt 106.

Then, both of the single-faced corrugated fiberboard sheet 1 and liner 3, in a laminated state, are conveyed as being held between the upper conveyor belt 106 and hot plate 105. Here, with an appropriate pressing force being applied thereto from the press rolls 110, the single-faced corrugated fiberboard sheet 1 and the liner 3 are bonded together as being heated by the hot plate 105, whereby the corrugated fiberboard sheet 4 is formed.

Thus formed corrugated fiberboard sheet 4 is conveyed as being held between the upper conveyor belt 106 and lower conveyor belt 111. Here, the bonding state between the single-faced corrugated fiberboard sheet 1 and the liner 3 is further secured, while their distortion, warping, and the like upon cooling are corrected.

In the above-mentioned conventional double facer 100, however, the upper conveyor belt 106 is disposed over substantially the whole region so as to oppose the hot plate 105, whereby the upper conveyor belt 106 and hot plate 105 always come into contact with the single-faced corrugated fiberboard sheet 1 and the liner 3. Consequently, there may be the following disadvantages.

Namely, in the process of heating the single-faced corrugated fiberboard sheet 1 and the liner 3 by the hot plate 105 and causing the glue to gel and dry, thereby bonding the single-faced corrugated fiberboard sheet 1 and the liner 3 together, moisture is released as the single-faced corrugated fiberboard sheet 1 and the liner 3 are heated. Consequently, the upper conveyor belt 106 absorbs thus released moisture at its portion in contact with the single-faced corrugated fiberboard sheet 1 and the liner 3, while releasing thus absorbed moisture at its portion not in contact with the single-faced corrugated fiberboard sheet 1 and liner 3. When moisture is absorbed and released by the upper conveyor belt 106, it influences the drying state of the glue applied between the single-faced corrugated fiberboard sheet 1 and the liner 3; and, according to circumstances, causes warping and the like in the corrugated fiberboard sheet 4, thereby deteriorating the quality of the latter.

Also, when the upper conveyor belt 106 is used for a long period of time, due to the above-mentioned absorption, release, and the like of moisture, it may lopsidedly wear out, or the glue and the like may adhere thereto, thereby forming irregularities on the belt surface. In this case, not only the conveyance of the upper conveyor belt 106 is influenced, but also the glue applied between the single-faced corrugated fiberboard sheet 1 and the liner 3 fails to attain a uniform drying state, thereby generating warping or the like in the corrugated fiberboard sheet 4 and deteriorating the quality thereof.

From such a viewpoint, it is preferable to do away with the upper conveyor belt 106. However, shortcomings may occur when the upper conveyor belt 106 is not provided. Namely, at the beginning of an operation in particular, i.e., when the single-faced corrugated fiberboard sheet 1 and the liner 3 are initially introduced into the machine, an operator must manually draw a tip of the single-faced corrugated fiberboard sheet 1 and the liner 3 so as to make them travel over the hot plate 105, thereby necessitating a large amount of time for preparation. This operation itself is difficult for the operator as well.

Meanwhile, the upper conveyor belt 106 of the double facer 100 functions to apply a conveying force to the single-faced corrugated fiberboard sheet 1 and liner 3 (yielding the corrugated fiberboard sheet 4 after being bonded together) and disperse the pressing force of the press rolls 110 so that it does not concentrate on one part.

Therefore, when the press rolls 110 each constituted as the rod-like member directly press the single-faced corrugated fiberboard sheet 1 and the liner 3, a local load may act on its contacting part with the single-faced corrugated fiberboard sheet 1, thereby collapsing the single-faced corrugated fiberboard sheet 1 and the liner 3.

On the other hand, the heat of the hot plate 105 constituting the double facer 100 is taken away by the single-faced corrugated fiberboard sheet 1 and liner 3 from thereabove, whereby the upper side of the hot plate 105 has a temperature lower than that on the lower side, thus generating thermal distortion between the upper and lower sides of the hot plate 105.

Also, how the heat is taken away from the hot plate 105 varies depending on the operation condition of the machine (e.g., conveying speed, width of the single-faced corrugated fiberboard sheet 1 and liner 3, and so on), thermal distortion may also occur on the upper surface of the hot plate 105 with a variable quantity.

Consequently, it has been difficult for the conventional press rolls 110 having a high flexural rigidity to apply an appropriate pressing force over the whole width of the single-faced corrugated fiberboard sheet 1 and liner 3 constantly and uniformly.

Also, depending on deviations of the thermal distortion and pressing force in the widthwise direction, the conventional press rolls 110 may fail to apply the pressing force uniformly over the whole surface of the single-faced corrugated fiberboard sheet 1 and liner 3, thus making it difficult to attain a favorable bonding state and improve the quality of the corrugated fiberboard sheet 4.

SUMMARY OF THE INVENTION

In view of such problems, it is an object of the present invention to provide a double facer which can yield favorable drying and bonding states between the single-faced corrugated fiberboard sheet and the liner, thereby improving the quality of corrugated fiberboard sheet.

To this aim, the double facer in accordance with the present invention is a double facer for bonding a single-faced corrugated fiberboard sheet and a liner so as to form a corrugated fiberboard sheet, the double facer comprising a heating member disposed along a conveying direction of the corrugated fiberboard sheet; a pressing unit, disposed to oppose the heating member, for pressing the corrugated fiberboard sheet against the heating member; a sheet conveying unit, disposed downstream the heating member, for conveying the corrugated fiberboard sheet; and a sheet feeding unit for feeding the corrugated fiberboard sheet toward the sheet conveying unit; wherein the pressing unit comprises a plurality of pressing devices disposed in series as being separated from each other along the conveying direction of the corrugated fiberboard sheet.

As a result of such a configuration, when the single-faced corrugated fiberboard sheet and the liner are bonded together, a predetermined gap occurs between a plurality of pressing devices disposed in series as being separated from each other, thus allowing the function for eliminating (evaporating) the moisture remaining in the double-faced corrugated fiberboard sheet to improve.

Consequently, the glue applied between the single-faced corrugated fiberboard sheet and the liner can have a uniform drying state, thus yielding a favorable bonding state between the single-faced corrugated fiberboard sheet and the liner. Accordingly, the double-faced corrugated fiberboard sheet can be restrained from being warped and distorted, whereby the present invention is advantageous in that the quality of double-faced corrugated fiberboard sheet can be improved.

The corrugated fiberboard sheet includes a double-faced corrugated fiberboard sheet, a double wall corrugated fiberboard sheet, a triple wall corrugated fiberboard sheet, or a multi wall corrugated fiberboard sheet formed by a larger number of layers.

Preferably, the plurality of pressing devices are disposed with a space therebetween, while the sheet feeding unit is disposed between the plurality of pressing devices.

Preferably, the pressing unit comprises a supporting member extending in a transverse direction perpendicular to the conveying direction, a plurality of weight blocks suspended from the supporting member via an elastic member and disposed in parallel, and vertically driving means for driving the supporting member to move up and down.

As a result of this configuration, when the supporting member suspending the weight blocks therefrom is moved up and down so that the weight block is set to a given position in the vertical direction, the elastic force of the elastic member suspending the weight blocks therefrom can be adjusted to increase or decrease, whereby the pressing force caused by weight blocks can be regulated arbitrarily.

Consequently, even when the single-faced corrugated fiberboard sheet and the liner are directly pressed, the pressing force would not act locally, whereby the single-faced corrugated fiberboard sheet and the liner can be uniformly pressed in the width wise direction. Accordingly, the present invention is advantageous in that a double-sided corrugated fiberboard sheet with a high quality having a high strength and a favorable flatness can be made.

Preferably, the plurality of weight blocks are constituted so as to directly come into contact with the single-faced corrugated fiberboard sheet or liner and press the single-faced corrugated fiberboard sheet or liner.

As a result of this configuration, unlike the conventional cases, the conveyor belt does not act to absorb/release moisture, whereby the corrugated fiberboard sheet can be securely restrained from generating warping and the like, thus allowing the corrugated fiberboard sheet to keep its quality from deteriorating.

Preferably, the elastic member is constituted by a spring inserted between the supporting member and each of the above-mentioned weight blocks, and the plurality of weight blocks are disposed in parallel in the conveying direction while each of which is formed into an elongated shape extending in the conveying direction.

As a result of this configuration, even when the single-faced corrugated fiberboard sheet and the liner are directly pressed, the pressing force would not act locally, whereby the single-faced corrugated fiberboard sheet and the liner can be uniformly pressed in the widthwise direction.

Preferably, the plurality of pressing devices are disposed with a gap therebetween, the pressing devices comprise a cutout portion which is formed by a part of the plurality of weight blocks having a smaller length, and the sheet feeding unit is disposed at the cutout portion.

Preferably, the pressing unit is provided with a guide section for restraining the weight blocks from moving in the conveying direction while allowing them to move in vertical directions and tilt in the transverse direction.

As a result of this configuration, movement of the weight blocks can be restricted appropriately, whereby the single-faced corrugated fiberboard sheet and the liner can be securely pressed.

Preferably, the pressuring unit comprises a plurality of planar members disposed along the conveying direction of the corrugated fiberboard sheet, each constituted by a shape steel, and a chamber disposed so as to oppose the plurality of planar members.

As a result of this configuration, the pressing forces acting on the single-faced corrugated fiberboard sheet and liner can be arbitrarily adjusted when the pressure within the chamber is regulated.

Consequently, even when the single-faced corrugated fiberboard sheet and the liner are directly pressed, the pressing force would not act locally, thus allowing an appropriate pressing force to be applied to the single-faced corrugated fiberboard sheet and the liner in the widthwise direction in a substantially uniform fashion. Accordingly, it is advantageous in that a double-sided corrugated fiberboard sheet with a high quality having a high strength and a favorable flatness can be made.

Preferably, the heating member is constituted by a plurality of planar members heated by steam.

Preferably, the sheet conveying unit is constituted by an upper conveyor belt disposed on the upper side and a lower conveyor belt disposed on the lower side, and the upper conveyor belt and lower conveyor belt convey the corrugated fiberboard sheet while holding it therebetween.

Preferably, the sheet feeding unit is constituted to be at a position in contact with the single-faced corrugated fiberboard sheet and the liner upon starting manufacture of the corrugated fiberboard sheet and at a position separated from the single-faced corrugated fiberboard sheet and the liner so as not to be in contact therewith after starting the manufacture.

As a result of this configuration, upon starting the manufacture of double-faced corrugated fiberboard sheet, the leading edge of the single-faced corrugated fiberboard sheet and liner is fed by the sheet feeding unit so as to be introduced into the sheet conveying unit downstream thereof. By contrast, when the double-faced corrugated fiberboard sheet is being made, the sheet feeding unit is disposed at a position separated from the single-faced corrugated fiberboard sheet and the liner so as not to be in contract therewith, whereby the single-faced corrugated fiberboard sheet and the liner are conveyed as being pulled by the sheet conveying unit downstream thereof. In this case, the pressing unit directly comes into contact with and presses the single-faced corrugated fiberboard sheet and the liner.

Consequently, it is advantageous in that the sheet feeding operation upon starting the manufacture of double-faced corrugated fiberboard sheet can be performed safely in a short period of time.

Preferably, the sheet feeding unit is disposed between the plurality of pressing devices so as to oppose the heating member.

Preferably, the sheet feeding unit comprises a roller, firmly supported by a rotary shaft driven to rotate, for feeding the single-faced corrugated fiberboard sheet and the liner, and height position adjusting means for adjusting height positions of the rotary shaft and roller; and the rotary shaft is placed at a position in contact with the single-faced corrugated fiberboard sheet and the liner upon starting manufacture of the corrugated fiberboard sheet, whereas the rotary shaft is placed at a position separated from the single-faced corrugated fiberboard sheet and the liner so as not to be in contact therewith after manufacture of the corrugated fiberboard sheet is started.

Preferably, the height position adjusting means comprises an arm for rotatably supporting the rotary shaft, an axis for firmly supporting the arm, and a lever secured to an end portion of the axis so as to be rotated together with the axis; and the lever is rotated such that the rotary shaft supported by the arm is placed at a position in contact with the single-faced corrugated fiberboard sheet and the liner upon starting manufacture of the corrugated fiberboard sheet, whereas the lever is rotated such that the rotary shaft supported by the arm is placed at a position separated from the single-faced corrugated fiberboard sheet and the liner so as not to be in contact therewith after manufacture of the corrugated fiberboard sheet is started.

Preferably, the lever has an upper protruded part and a lower protruded part, and comprises an air cylinder, adapted to abut to the upper protruded part, for rotating the lever in one direction, and an elastic member, attached to the lower protruded part, for rotating the lever in an opposite direction; and the air cylinder is caused to abut to the upper protruded part so as to rotate the lever in the one direction such that the rotary shaft supported by the arm is placed at a position in contact with the single-faced corrugated fiberboard sheet and the liner upon starting manufacture of the corrugated fiberboard sheet, whereas the elastic member causes the lever to rotate in the opposite direction such that the rotary shaft supported by the arm is placed at a position separated from the single-faced corrugated fiberboard sheet and the liner so as not to be in contact therewith after manufacture of the corrugated fiberboard sheet is started.

The method of forming a corrugated fiberboard sheet in accordance with the present invention is a method of forming a corrugated fiberboard sheet by a double facer in which a single-faced corrugated fiberboard sheet and a liner are bonded together to form the corrugated fiberboard sheet, the method comprising, at first, upon starting manufacture of the corrugated fiberboard sheet, placing a sheet feeding unit at a position in contact with the single-faced corrugated fiberboard sheet and the liner, and feeding a leading edge of the single-faced corrugated fiberboard sheet and liner downstream in a conveying direction by the sheet feeding unit so that the leading edge is introduced into a sheet conveying unit; and, after manufacture of the corrugated fiberboard sheet is started, placing the sheet feeding unit at a position separated from the single-faced corrugated fiberboard sheet and the liner so as not to be in contact therewith, pressing the single-faced corrugated fiberboard sheet and the liner by a plurality of pressuring devices disposed in seires as being separated from each other along the conveying direction while conveying the single-faced corrugated fiberboard sheet and the liner by the sheet conveying unit, and heating and bonding together the single-faced corrugated fiberboard sheet and the liner by a heating member disposed so as to oppose the pressing devices.

As a result, upon starting manufacture of the double-faced corrugated fiberboard sheet, the leading edge of the single-faced corrugated fiberboard sheet and liner is fed by the sheet feeding unit so as to be introduced into the sheet conveying unit downstream thereof. By contrast, when the double-faced corrugated fiberboard sheet is being made, the sheet feeding unit is placed at a position separated from the single-faced corrugated fiberboard sheet and the liner so as not to be in contact therewith, whereby the single-faced corrugated fiberboard sheet and the liner are conveyed as being pulled by the sheet conveying unit downstream thereof. In this case, the pressing device directly comes into contact with and presses the single-faced corrugated fiberboard sheet and the liner.

Consequently, it is advantageous in that the sheet feeding operation upon starting the manufacture of double-faced corrugated fiberboard sheet can be performed safely in a short period of time.

DESCRIPTION OF THE PREFERRED EMBODIMENTS

In the following, embodiments of the present invention will be explained with reference to the drawings. FIGS. 1 to 6 are views showing a double facer of a corrugating machine in accordance with an embodiment of the present invention.

Figure 1:
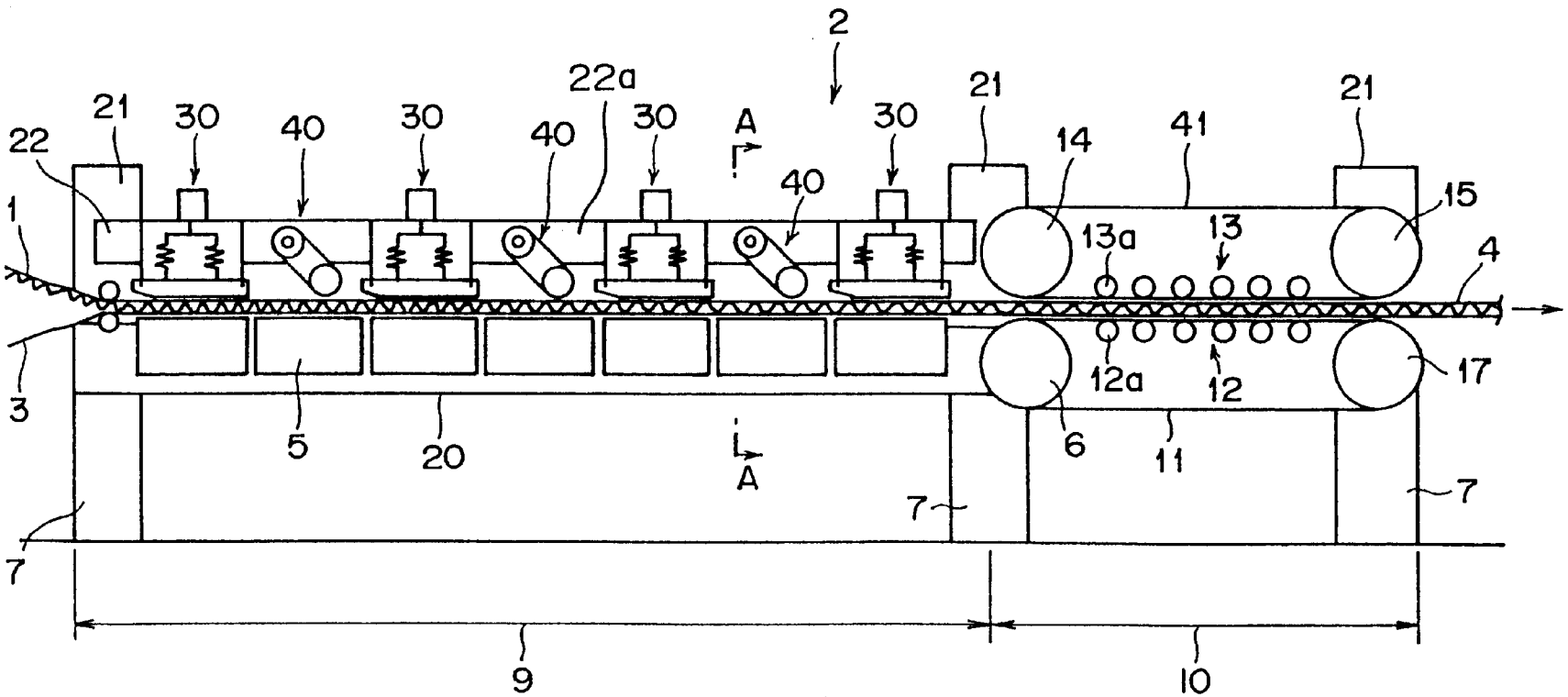
FIG. 1 is a side view schematically showing an overall configuration of a double facer in accordance with an embodiment of the present invention.

As shown in FIG. 1, a double facer 2 of the corrugating machine in accordance with this embodiment is constituted by a heating part 9 and a cooling part 10; and bonds together a single-faced corrugated fiberboard sheet 1, which is formed by a non-depicted single facer upstream the double facer 2 and then is provided with a glue at non-depicted glue machine, and a liner 3 conveyed from a non-depicted mill roll stand, thereby making a corrugated fiberboard sheet 4. In FIG. 1, an arrow indicates the conveying direction.

Figure 10A:
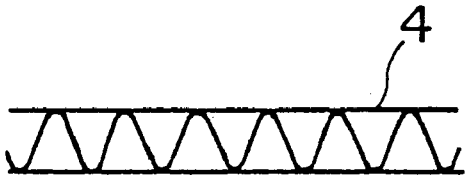
FIGS. 10(A) to 10(C) are sectional views schematically showing typical corrugated fiberboard sheets, respectively representing a double-faced corrugated fiberboard sheet, a double wall corrugated fiberboard sheet, and a triple wall corrugated fiberboard sheet.
Figure 10B:
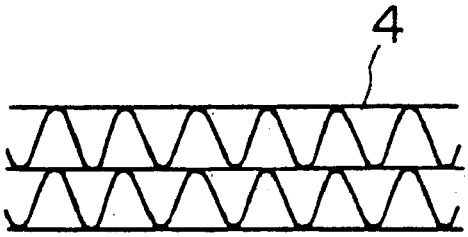
Figure 10C:
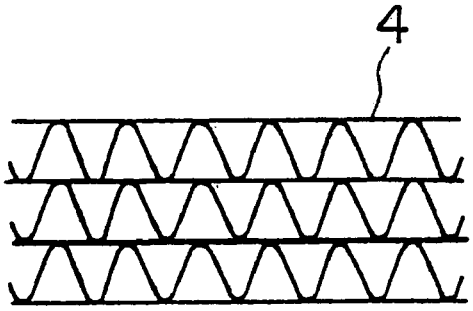

Though the double facer in accordance with this embodiment is explained as the one forming a double-faced corrugated fiberboard sheet such as that shown in FIG. 10(A) as the corrugated fiberboard sheet, the present invention is also applicable to double facers which form a double wall corrugated fiberboard sheet such as that shown in FIG. 10(B), a triple wall corrugated fiberboard sheet such as that shown in FIG. 10 (C), and a multi wall corrugated fiberboard sheet comprising a larger number of layers.

The heating part 9 constituting the double facer 2 is a part which bonds the single-faced corrugated fiberboard sheet 1 and the liner 3 together so as to form the corrugated fiberboard sheet 4 by heating the single-faced corrugated fiberboard sheet 1 and the liner 3 while pressing them. It comprises a hot plate (heating box) 5 as a heating member for heating the single-faced corrugated fiberboard sheet 1 and the liner 3, a plurality of sheet feeding units 40 for feeding the single-faced corrugated fiberboard sheet 1 and the liner 3, and a plurality of pressing devices 30 for pressing the single-faced corrugated fiberboard sheet 1 and liner 3 (yielding the corrugated fiberboard sheet 4 after being bonded together) while pressing them against the hot plate 5.

Here, the hot plate 5 is constituted by a plurality of planar members appropriately heated by steam, and heats the single-faced corrugated fiberboard sheet 1 and the liner 3 while coming into contact with the liner 3 being conveyed.

Figure 2:
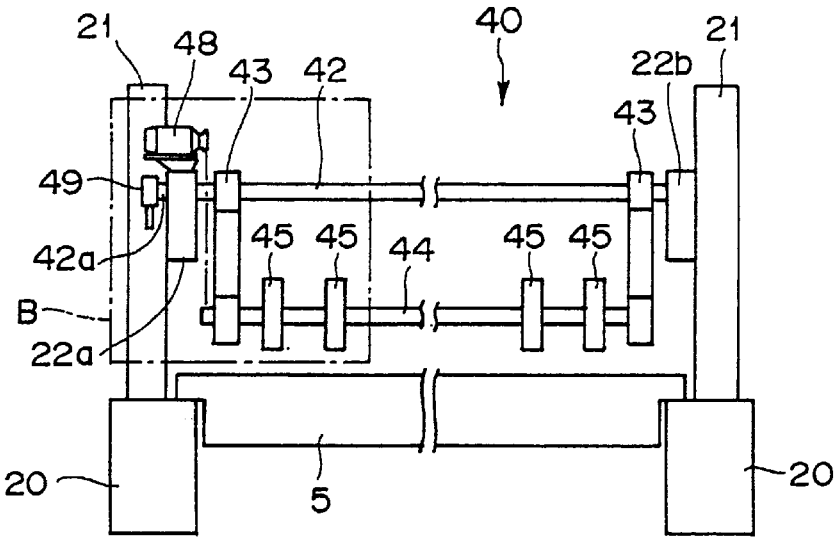
FIG. 2 is a schematic view showing a sheet feeding unit of the double facer in accordance with the embodiment of the present invention, which is a sectional view taken along line A—A of FIG. 1.

As shown in FIGS. 1 and 2, the hot plate 5 is disposed on a main frame 20 which extends over the whole length in the conveying direction below both side portions of the double facer 2. The main frame 20 is supported by posts 7.

Also, as shown in FIGS. 1 and 2, between movable frames 22*a* and 22*b* which extend over the whole length in the conveying direction above both side portions of the double facer 2, the sheet feeding units 40 and pressing devices 30 are disposed so as to oppose the hot plate 5.

Here, a plurality of the pressing devices 30 are disposed in series as being separated from each other along the conveying direction of the corrugated fiberboard sheet 4, while forming predetermined spaces between the individual pressing devices 30. These spaces are formed such that the release of the moisture remaining within the single-faced corrugated fiberboard sheet 1 and liner 3 (yielding the corrugated fiberboard sheet 4 after being bonded together) can be improved, i.e., such that the evaporating function can be improved. As a result, the drying state of the glue applied between the single-faced corrugated fiberboard sheet 1 and the liner 3 can be made uniform. The pressing devices 30 will be explained later in detail.

The sheet feeding units 40, which feed the single-faced corrugated fiberboard sheet 1 and the liner 3 to an upper conveyor belt 41 and lower conveyor belt 11 as a sheet conveying unit explained later, are respectively inserted between a plurality of pressing devices 30 disposed with predetermined intervals. Details of the sheet feeding units 40 will be explained later.

On the other hand, the cooling part 10 constituting the double facer 2 cools the corrugated fiberboard sheet 4 formed by the heating part 9 and makes the bonding state more secure, while functioning to correct distortion, warping, and the like upon cooling.

As shown in FIG. 1, the cooling part 10 comprises the upper conveyor belt 41 and lower conveyor belt 11 as the sheet conveying unit, and pressing units 12 and 13. Here, the corrugated fiberboard sheet 4 formed at the heating part 9 is held between and conveyed by the lower conveyor belt 11 and the upper conveyor belt 41, while being pressed by the pressing units 12 and 13.

The upper conveyor belt 41 is wound around two drums 14 and 15. The pressing unit 13 constituted by a plurality of rollers 13*a* is provided so as to press the back face of the upper conveyor belt 41.

On the other hand, the lower conveyor belt 11 is wound around two drums 16 and 17, and is provided with the pressing unit 12, which is constituted by a plurality of rollers 12*a* so as to press the back face of the upper conveyor belt 11.

The upper conveyor belt 41 and the lower conveyor belt 11 are disposed so as to oppose each other and are commonly supported by support frames 21 and 21.

In the following, the sheet feeding unit 40 in the double facer in accordance with this embodiment will be explained with reference to FIGS. 2 to 4.

As shown in FIG. 2, the sheet feeding unit 40 lets the single-faced corrugated fiberboard sheet 1 and the liner 3 in upon starting manufacture of the corrugated fiberboard sheet 4, i.e., feeds the leading edge of the single-faced corrugated fiberboard sheet 1 and liner 3 such that it is introduced between the upper conveyor belt 41 and lower conveyor belt 11 constituting the cooling part 10 downstream thereof.

The sheet feeding unit 40 is disposed between the left and right movable frames 22*a* and 22*b* suspended from the support frames 21 and 21 that are vertically disposed on the main frames 20 and 20, so as to oppose the hot plate 5 disposed on the main frames 20 and 20. It comprises an axis 42, arms 43 and 43, a rotary shaft 44, a plurality of rollers 45, a motor 48, and a lever 49.

As shown in FIG. 2, the axis 42 is axially supported by the movable frames 22*a* and 22*b* in a rotatable fashion. The axis 42 is linked to the rotary shaft 44 via the arms 43. Namely, as shown in FIG. 3, one end portion 43*a* of the arm 43 is firmly supported by the axis 42, while the other end portion 43*b* thereof is rotatably supported by the rotary shaft 44, whereby the axis 42 and the rotary shaft 44 are linked to each other via the arm 43.

Also, as shown in FIG. 2, a plurality of the rollers 45 for feeding the leading edge of the single-faced corrugated fiberboard sheet 1 and the liner 3 is integrally secured to the rotary shaft 44. The rotary shaft 44 having the plurality of rollers 45 secured thereto is driven to rotate by the motor 48 disposed above the movable frame 22*a*.

Figure 3:
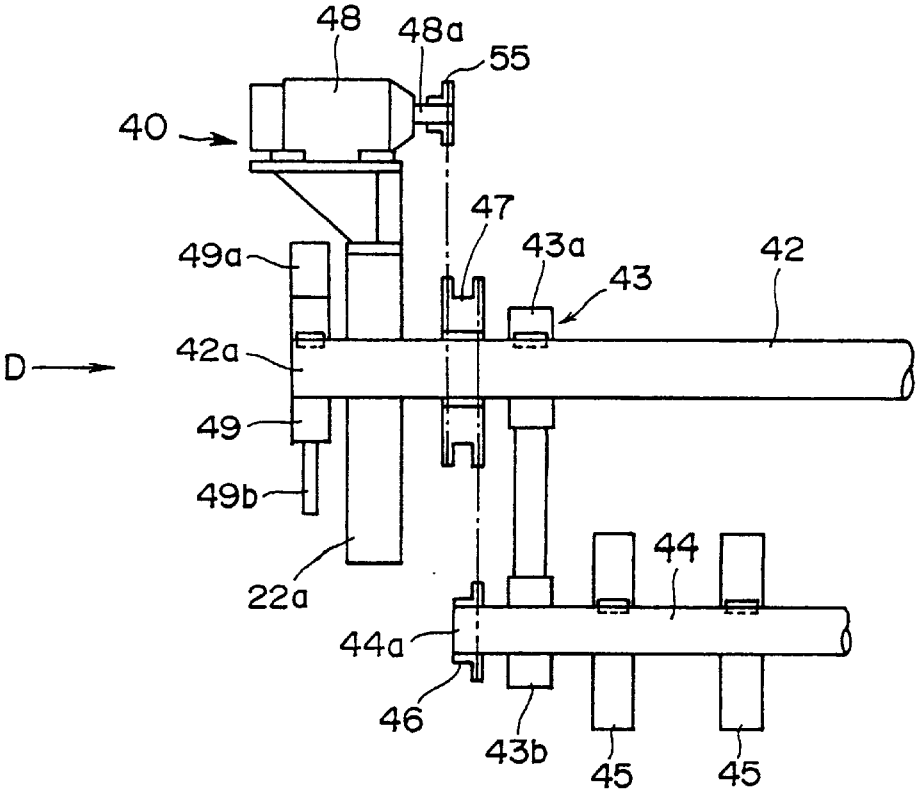
FIG. 3 is a schematic view showing a sheet feeding unit of the double facer in accordance with the embodiment of the present invention, which is an enlarged view of part B in FIG. 2.

Namely, as shown in FIG. 3, the rotary shaft 44 equipped with the plurality of rollers 45 is driven by the motor 48 via sprockets 46, 47, and 55. For this purpose, the sprocket 55 is attached to an end portion of a rotary shaft 48*a* of the motor 48, the sprocket 47 is rotatably attached to the axis 42, and the sprocket 46 is attached to an end portion 44*a* of the rotary shaft 44, whereby the turning force of the motor 48 is transmitted to the rotary shaft 44.

Figure 4:
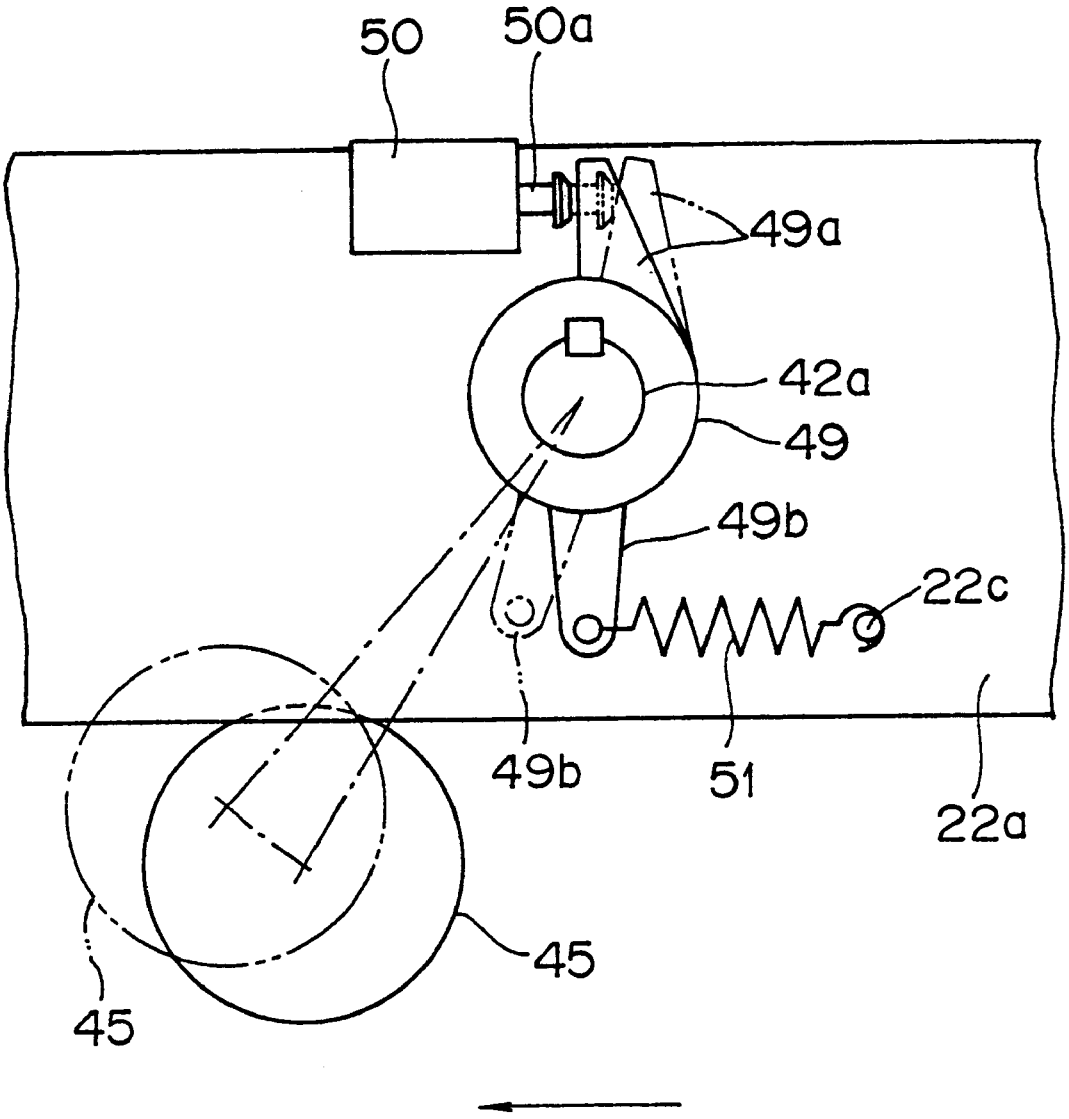
FIG. 4 is a side view schematically showing a lever of the sheet feeding unit in the double facer in accordance with the embodiment of the present invention, which is a view observed in direction of arrow D in FIG. 3.

Also, the shaft 42 penetrates through the movable frame 22*a*, whereas attached to its end portion 42*a* projecting outside thereof is the lever 49 comprising an upper protruded part 49*a* and a lower protruded part 49*b* as shown in FIG. 4. The lever 49 rotates together with the axis 42. In FIG. 4, an arrow indicates the conveying direction.

The lever 49 is driven by an air cylinder 50. For this purpose, the air cylinder 50 equipped with a rod 50*a* is disposed on a side face of the movable frame 22*a* downstream the upper protruded part 49*a* of the lever 49. On the other hand, a stick-like engagement part 22*c* is formed on the side face of the movable frame 22*a* upstream the lower protruded part 49*b* of the lever 49, while a tension spring 51 is inserted between the engagement part 22*c* and the lower protruded part 49*b* of the lever 49.

Consequently, the tension spring 51 biases the lower protruded part 49*b* of the lever 49 toward the engagement part 22*c* (rightward in the drawing), thereby rotating the lever 49 such that the upper protruded part 49*a* thereof abuts to the front end portion of the rod 50*a* and is located on the vertically upper side of the axis 42, whereas the lower protruded part 49*b* thereof is located on the vertically lower side of the axis 42. FIG. 4 shows a state where the rod 50*a* of the air cylinder 50 is retracted.

In this case, the rollers 45 attached to the rotary shaft 44 are set at a descended position, i.e., at a height position in contact with the single-faced corrugated fiberboard sheet 1 and the liner 3. Upon starting manufacture of the corrugated fiberboard sheet 4, the rollers 45 feed the leading edge of the single-faced corrugated fiberboard sheet 1 and liner 3 downstream in the conveying direction so that it is introduced between the upper conveyor belt 41 and the lower conveyor belt 11.

Subsequently, after the manufacture of corrugated fiberboard sheet 4 is started, air is supplied into the air cylinder 50, so as to advance the rod 50*a* to push the upper protruded part 49*a* of the lever 49, thus rotating the lever 49 against the bias force of the tension spring 51 at the lower protruded part 49*b* of the lever 49, whereby the axis 42, arms 43, and rotary shaft 44 are rotated so as to move up the roller 45.

Consequently, the plurality of rollers 45 attached to the rotary shaft 44 are adjusted to a height position separated from the single-faced corrugated fiberboard sheet 1 and liner 3 conveyed between the rollers 45 and the hot plate 5, so as not to be in contact therewith. Thus, when the corrugated fiberboard sheet 4 is being manufactured, the turning force of the roller 45 would not act on the single-faced corrugated fiberboard sheet 1 and the liner 3.

Here, the axis 42, arms 43 and 43, lever 49, air cylinder 50, and tension spring (elastic member) 51 are referred to as height position adjusting means since they adjust the height position of the rotary shaft 44 and roller 45.

Figure 5:
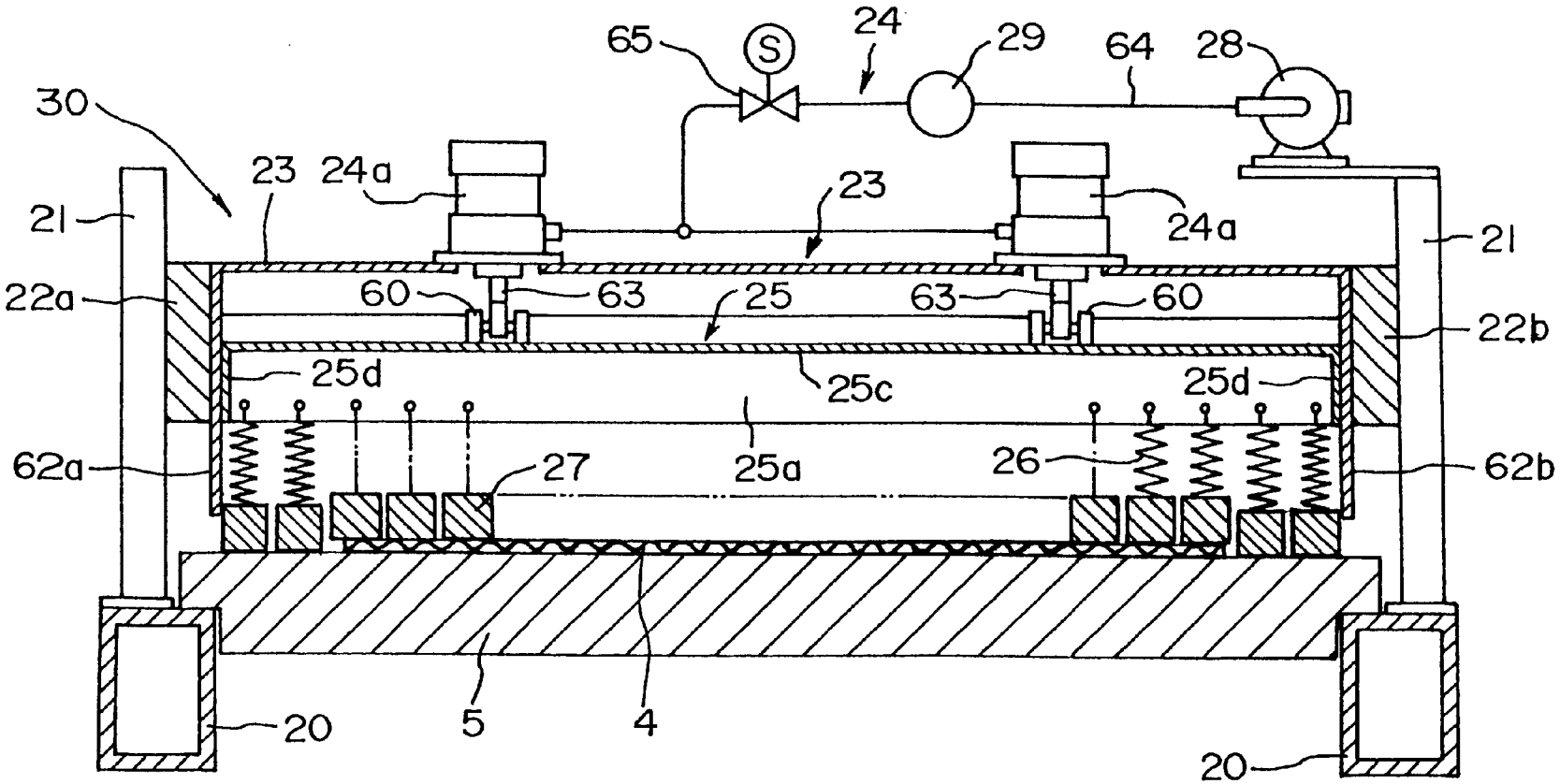
FIG. 5 is a schematic view showing a pressing device in the double facer in accordance with the embodiment of the present invention, which is a sectional view taken along line C—C in FIG. 6.

In the following, the pressing device 30 in the double facer in accordance with this embodiment will be explained. FIG. 5 is a schematic sectional view thereof.

As shown in FIG. 5, the pressing device 30 comprises a vertically movable plate 25 as a supporting member, a plurality of weight blocks 27, a spring 26 as an elastic member inserted between the vertically movable plate 25 and each weight block 27, and vertically driving means 24 for vertically driving the vertically movable plate 25.

The pressing device 30 is disposed so as to oppose the hot plate 5 as the heating member, and presses the corrugated fiberboard sheet 4 on the hot plate 5 by pushing the former against the latter. Namely, the pressing device 30 causes the vertical dead weight of the plurality of weight blocks 27 suspended from the vertically movable plate 25 via the plurality of springs 26 to act on the corrugated fiberboard sheet 4 as a pressure (pressing force), thus pressing the corrugated fiberboard sheet 4 by pushing it against the hot plate 5.

Figure 6:
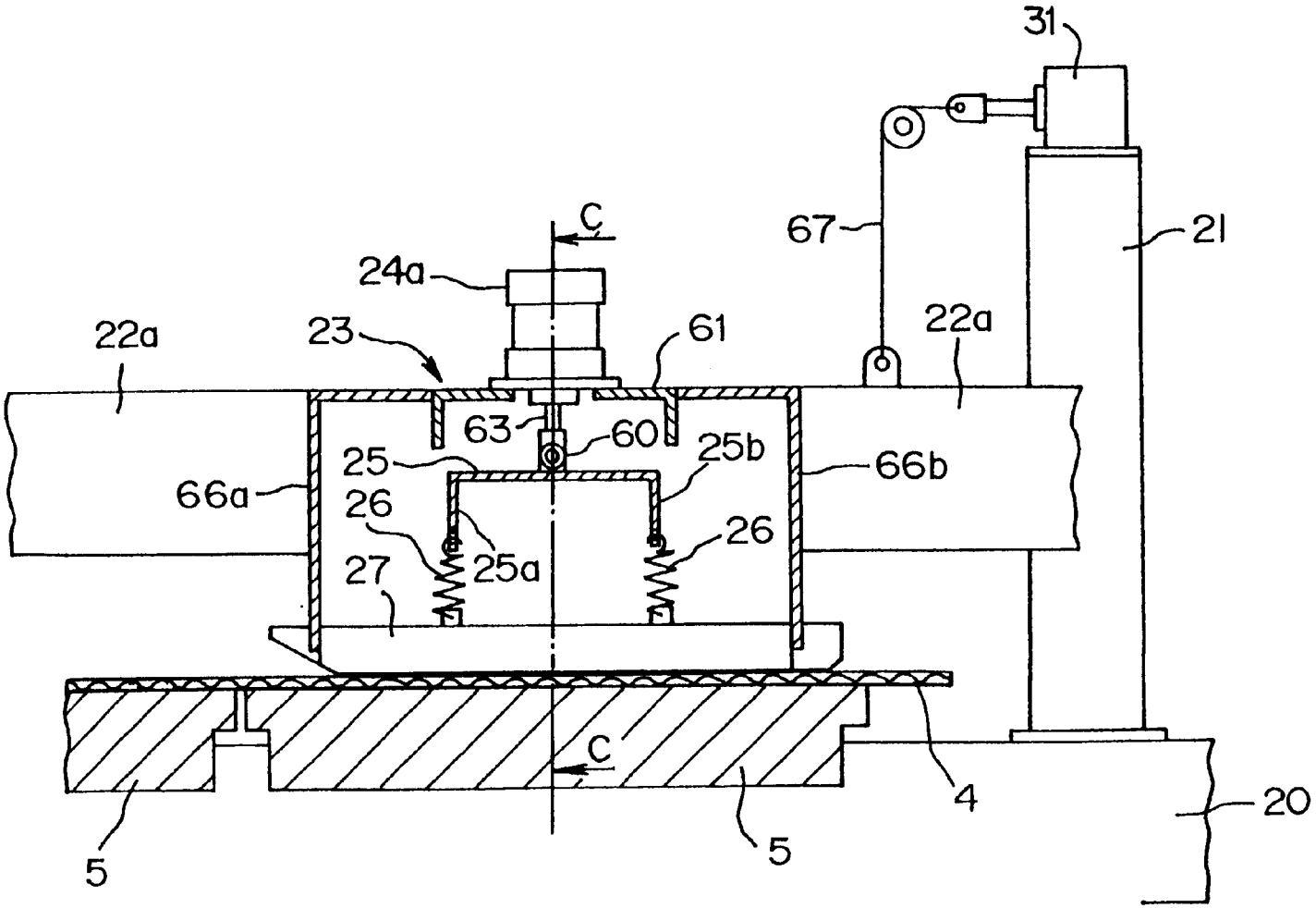
FIG. 6 is a vertical sectional view schematically showing the pressing device in the double facer in accordance with the embodiment of the present invention.

Here, as shown in FIG. 6, each of the plurality of weight blocks 27 is formed into an elongated shape extending in the conveying direction of the corrugated fiberboard sheet 4, with a substantially square cross section. The upstream side of each weight block in the sheet conveying direction is shaped like a wedge so as to make it easier for the single-faced corrugated fiberboard sheet 1 and liner 3 (yielding the corrugated fiberboard sheet 4 after being bonded together) to travel.

As shown in FIG. 5, via the springs (tension springs) 26, the plurality of weight blocks 27 are suspended from the vertically movable plate 25 in parallel to the conveying direction of the corrugated fiberboard sheet 4, i.e., along the widthwise direction of the corrugated fiberboard sheet 4, with narrow intervals therebetween.

As shown in FIGS. 5 and 6, the plurality of weight blocks 27 abut to the upper face of the corrugated fiberboard sheet 4 being conveyed, thus directly pressing the corrugated fiberboard sheet 4.

As shown in FIG. 6, the springs 26 are attached to each weight block 27 at two positions respectively on the upstream and downstream sides in the sheet conveying direction.

Each spring 26 is a coil spring generating a force (tensile force) for pulling each weight block 27 upward, whereby the pressing force to the corrugated fiberboard sheet 4 can be adjusted by balancing the vertical dead weight of the weight block 27 and the vertically upward tensile force of the spring 26 against each other.

As shown in FIGS. 5 and 6, the vertically movable plate 25 comprises spring attachment plate sections 25*a* and 25*b* respectively formed on the upstream side and downstream side in the conveying direction of the corrugated fiberboard sheet 4 so as to extend in lateral directions perpendicular to the conveying direction; and linking plate sections 25*c* and 25*d* for connecting the spring attachment plate sections 25*a* and 25*b* together. The vertically movable plate 25 is configured to have an inverted U-like cross section in a lateral direction perpendicular to the conveying direction of the corrugated fiberboard sheet 4 as shown in FIG. 5, while also having an inverted U-like cross section in a direction along the conveying direction of the corrugated fiberboard sheet 4 as shown in FIG. 6.

As shown in FIGS. 5 and 6, via pins 60 attached to two positions on the left and right sides along the widthwise direction of the corrugated fiberboard sheet 4, the vertically movable plate 25 is swingingly attached to the vertically driving means 24, which will be explained later, attached to a gutter-shaped side beam 61 which is formed into a gutter-like shape. The vertically movable plate 25 is moved up and down by the vertically driving means 24. During such movement, the linking plate sections 25*d* and 25*d* constituting both side portions of the vertically movable plate 25 slide along the inner side faces of side walls 62*a* and 62*b* firmly attached to the gutter-shaped side beam 61, which will be explained later.

The vertically driving means 24 moves up and down the vertically movable plate 25 suspending the plurality of weight blocks 27 therefrom and, by means of a compressed air pressure applied to an air cylinder 24*a,* controls the tensile force of the spring 26 that pulls the plurality of weight blocks 27 upward.

As shown in FIG. 5, the vertically driving means 24 comprises the air cylinder 24*a* equipped with a rod 63 connected to the pin 60 attached to the vertically movable plate 25, a compressor (compressed air source) 28 for supplying compressed air to this single-acting air cylinder 24*a,* a pipe 64, a regulator 29, and a solenoid valve 65.

As the compressed air supplied via a pipe 64 from the compressor 28 is supplied to a rod-compression-side chamber of the air cylinder 24*a* (i.e., chamber for moving up the vertically movable plate 25), the rod 63 provided within the air cylinder 24*a* is driven so as to move the vertically movable plate 25 up and down. Here, the pressure of compressed air supplied from the compressor 28 is adjusted by the regulator 29, and the supply of compressed air is controlled by the solenoid valve 65.

The air cylinder 24*a* may be either manually operated or automatically controlled by use of a control unit.

The pressing force to the corrugated fiberboard sheet 4 is made adjustable as the vertically driving means 24 regulates the position of the weight blocks 27, in order to allow an appropriate pressing force to be set according to a material constituting the corrugated fiberboard sheet 4. Namely, it is due to the fact that a low pressing force should be set for soft sheet materials so as not to collapse the corrugated fiberboard sheet 4, while a high pressing force should be set for highly rigid sheet materials in order to bond them securely.

The vertically driving means 24 comprises two air cylinders 24*a* and 24*a,* which are disposed along the gutter-shaped side beam 61.

Here, the gutter-shaped side beam 61, to which the air cylinders 24*a* and 24*a* are attached, will be explained.

As shown in FIG. 6, a front wall 66*a* and a rear wall 66*b,* each having an L-shaped cross section, are respectively attached to the gutter-shaped side beam 61 on the front side and rear side in the traveling direction.

The lower end of the rear wall 66*b* is provided with plurality of cutout portions (guide portions) in a comb-like form, with which the rear end portion of the weight block 27 having a widthwise-reduced cross section engages.

The cutout portion restrains the weight block 27 from moving in the traveling direction while allowing it to move vertically and tilt laterally.

Also, as shown in FIG. 5, the side walls 62*a* and 62*b* are firmly attached to both side portions of the gutter-shaped side beam 61, front wall 66*a,* and rear wall 66*b* by welding or the like. The gutter-shaped side beam 61, side walls 62*a* and 62*b,* front wall 66*a,* and rear wall 66*b* form a pressing box 23.

The side walls 62*a* and 62*b* restrain the pressing box 23 from moving in the widthwise direction, thereby being capable of restricting the widthwise movement of the weight block 27.

Also, as shown in FIGS. 5 and 6, the movable frames 22*a* and 22*b* extending over substantially the whole length of the heating part 9 are respectively attached to the side walls 62*a* and 62*b* constituting the pressing box 23. The movable frames 22*a* and 22*b* are suspended via a wire 67 from a lift device 31 which is firmly attached to the upper part of the support frame 21.

As the lift device 31 drives the movable frames 22*a* and 22*b* to ascend and descend, the pressing box 23 can move up and down, whereby the plurality of weight blocks 27 disposed within the pressing box 23 can come into contact with and move away from the hot plate 5. In this case, the outer side faces of the movable frames 22*a* and 22*b* slide against the inner side faces of the support frames 21 and 21.

Here, a plurality of lift devices 31 are disposed along the sheet conveying direction.

The pressure caused by the weight block 27 of thus configured pressing device 30 is set as explained in the following so as to become a pressure (sheet pressing force) necessary for bonding the corrugated fiberboard sheet 4.

First, the vertically driving means 24 is actuated so as to contract the rod 63 of the air cylinder 24*a,* thereby moving up the vertically movable plate 25 to its highest position, while the lift device 31 causes the pressing box 23 to ascend to a predetermined position. In this manner, the tensile force of the spring 26 is made equivalent to the vertically downward force caused by the dead weight of the weight block 27, thus allowing the latter to lift up. As a result, a predetermined gap is formed between the weight block 27 and the hot plate 5.

Subsequently, in the case where the rigidity of the corrugated fiberboard sheet 4 is high, the lift device 31 is actuated so as to set the pressing box 23 to a predetermined height, and the air pressure supplied to the rod-contracting-side chamber of the air cylinder 24*a* is reduced or nullified. Thus, the vertically movable plate 25 is moved down to its lowest position, and the tensile force of the spring 26 is reduced or nullified, such that the whole dead weight of the weight block 27 would act on the corrugated fiberboard sheet 4.

In this case, since the tensile force of the spring 26 (spring tension) hardly acts thereon, the load applied to the corrugated fiberboard sheet 4 (pressing force onto the corrugated fiberboard sheet 4 caused by the weight block 27) substantially equals the whole deadweight of the weight block 27.

Consequently, the whole weight of the weight block 27 acts on the highly rigid corrugated fiberboard sheet 4, whereby even the highly rigid corrugated fiberboard sheet 4 can be securely pressed and firmly bonded.

In the case where the rigidity of the corrugated fiberboard sheet 4 is low, on the other hand, the air pressure supplied to the rod-contracting-side chamber of the air cylinder 24*a* is gradually increased so as to move up the vertically movable plate 25, thereby enhancing the tensile force of the spring 26. Consequently, the vertically upward lifting force acting on the weight block 27 gradually increases, thus gradually decreasing the pressing force of the weight block 27 onto the corrugated fiberboard sheet 4.

In this case, the load applied to the corrugated fiberboard sheet 4 (pressing force onto the corrugated fiberboard sheet 4 caused by the weight block 27) has a magnitude obtained when the tensile force of the spring 26 is subtracted from the dead weight of the weight block 27.

As the air pressure supplied to the rod-contracting-side chamber of the air cylinder 24*a* is further increased, the vertically movable plate 25 is further moved up, thereby further enhancing the tensile force of the spring 26. Consequently, the tensile force of the spring 26 becomes greater than the dead weight of the weight block 27, thereby allowing the weight block 27 to lift up in due time. Thus, the pressing force onto the corrugated fiberboard sheet 4 caused by the weight block 27, i.e., the load applied to the corrugated fiberboard sheet 4 becomes zero.

Accordingly, as the air pressure supplied to the air cylinder 24*a* is increased or decreased, the sheet pressing force caused by the weight block 27 can be arbitrarily changed within the range from the whole weight of the weight block 27 to zero, thus allowing the most suitable pressing force to be set.

Since the double facer as an embodiment of the present invention is thus configured, a corrugated fiberboard sheet is formed by this double facer in a method explained in the following.

First, upon starting manufacture of the corrugated fiberboard sheet 4, the plurality of rollers 45 of the sheet feeding unit 40 are set to a descended position, i.e., position in contact with the single-faced corrugated fiberboard sheet 1 and the liner 3, and the leading edge of the corrugated fiberboard sheet 1 and liner 3 supplied from the upstream side of the double facer 2 is fed by the plurality of rollers 45 toward the downstream side in the conveying direction so as to be introduced between the upper conveyor belt 41 and lower conveyor belt 11 constituting the downstream side portion of the double facer 2.

After the leading edge of the single-faced corrugated fiberboard sheet 1 and the liner 3 is thus fed, the rod 50*a* of the air cylinder 50 is advanced as indicated by a chain double-dashed line in FIG. 4, so as to push a side face of the upper protruded part 49*a* of the lever 49, thereby rotating the lever 49 against the bias force of the tension spring 51 acting on the lower protruded part 49*b* of the lever 49. Consequently, the axis 42 attached to the lever 49 and the rotary shaft 44 linked to the axis 42 via the arms 43 are rotated, whereby the plurality of rollers 45 attached to the rotary shaft 44 are moved up to the position indicated by a chain double-dashed line in FIG. 4, i.e., position separated from the corrugated fiberboard sheet 1 and the liner 3 so as not to be in contact therewith.

After manufacture of the corrugated fiberboard sheet 4 is started, the single-faced corrugated fiberboard sheet 1 and the liner 3 are conveyed as being pulled by the upper conveyor belt 41 and lower conveyor belt 11 constituting the cooling part 10 disposed downstream the heating part 9.

Thus conveyed single-faced corrugated fiberboard sheet 1 and liner 3 are bonded together at the heating part 9, thereby forming the corrugated fiberboard sheet 4. Namely, the single-faced corrugated fiberboard sheet 1 and the liner 3 are directly pressed by the weight blocks of a plurality of pressing devices 30 disposed in parallel with intervals along the conveying direction, thus being pushed against the hot plate 5 disposed opposite to the pressing devices 30 and being heated thereby, and are bonded together as the glue applied to the single-faced corrugated fiberboard sheet 1 is gelled and dried.

The corrugated fiberboard sheet 4 thus formed by bonding is subsequently conveyed to the cooling part 10, where it is pressed by the pressing units 12 and 13 while being held between the upper conveyor belt 41 and the lower conveyor belt 11, whereby the bonding state becomes more secure, and the distortion, warping, and the like are corrected.

With the double facer of this embodiment thus operated, when the single-faced corrugated fiberboard sheet 1 and the liner 3 are bonded together as being pressed by the pressing unit 30 while being heated by the hot plate 5 at the heating part 9, a predetermined gap is formed between the plurality of pressing devices 30 disposed with intervals, thus making it possible to improve the function of releasing the moisture remaining within the corrugated fiberboard sheet 4, i.e., improve the evaporating function.

As a result, the drying state of the glue applied between the single-faced corrugated fiberboard sheet 1 and the liner 3 becomes uniform, thus yielding a favorable bonding state between the single-faced corrugated fiberboard sheet 1 and the liner 3. Consequently, it is advantageous in that the warping and distortion of the corrugated fiberboard sheet 4 can be suppressed, thus allowing the quality of the corrugated fiberboard sheet 4 to improve.

Also, since many weight blocks 27 of the pressing devices 30 independently press the sheet in the widthwise direction of the hot plate 5, it is advantageous in that, even when the hot plate 5 is thermally deformed, the sheet can be pressed by a uniform force along the deformed hot plate 5.

Also, as the vertically movable plate 25 equipped with a plurality of weight blocks 27 is moved up and down by the vertically driving means 24 such that the position of plurality of weight blocks 27 is set to a given position in the vertical direction, the elastic force of the spring 26 suspending the weight blocks 27 can be adjusted to increase or decrease, thus allowing the pressing force caused by the dead weight of the weight blocks 27 to be regulated to increase or decrease. Accordingly, it is also advantageous in that, when making the corrugated fiberboard sheet 4, the pressing force thereon can be adjusted arbitrarily.

Therefore, it is advantageous in that a corrugated fiberboard sheet with a high quality having a high strength and a favorable flatness can be made.

Figure 7:
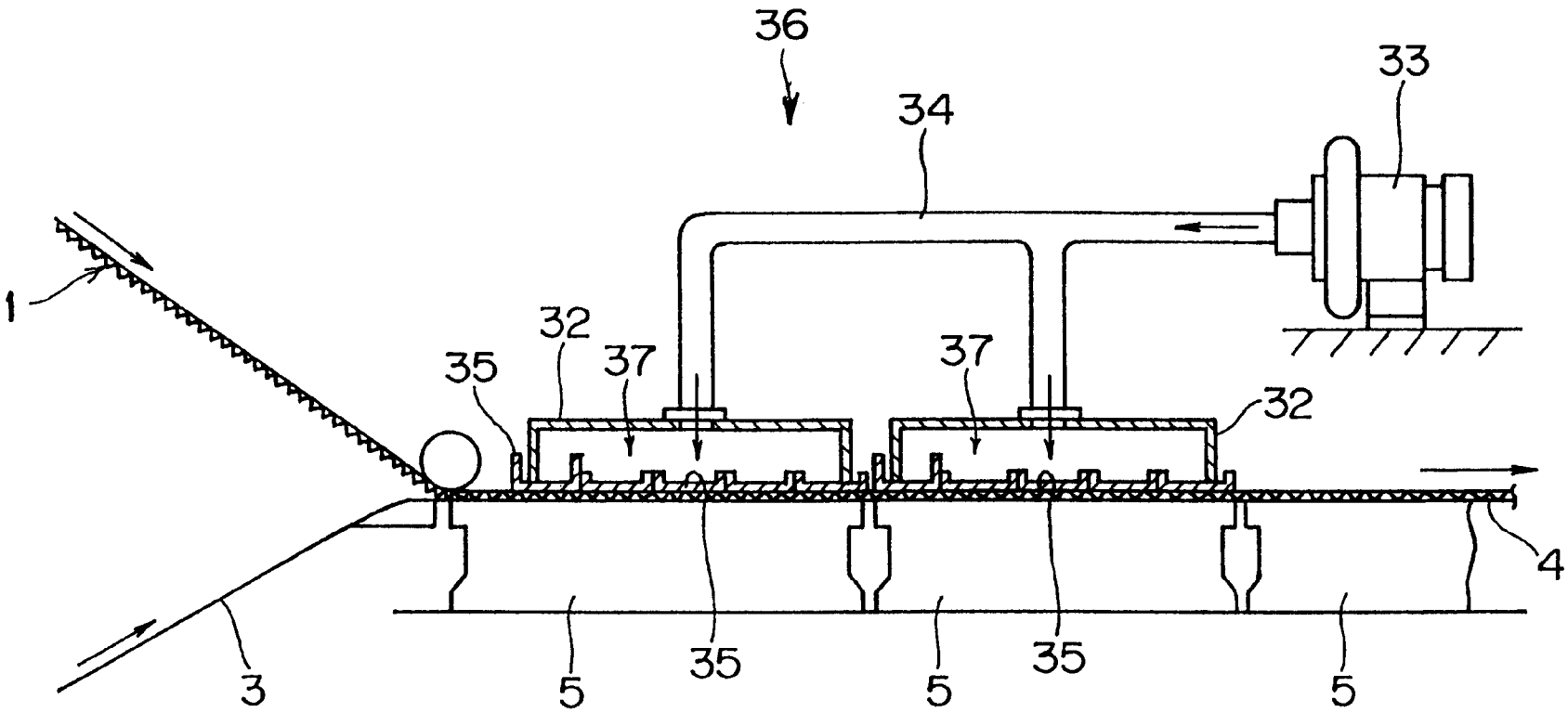
FIG. 7 is a schematic side view showing, with a partial section, a pressing device in the double facer in accordance with a modified example of the embodiment of the present invention.
Figure 8:
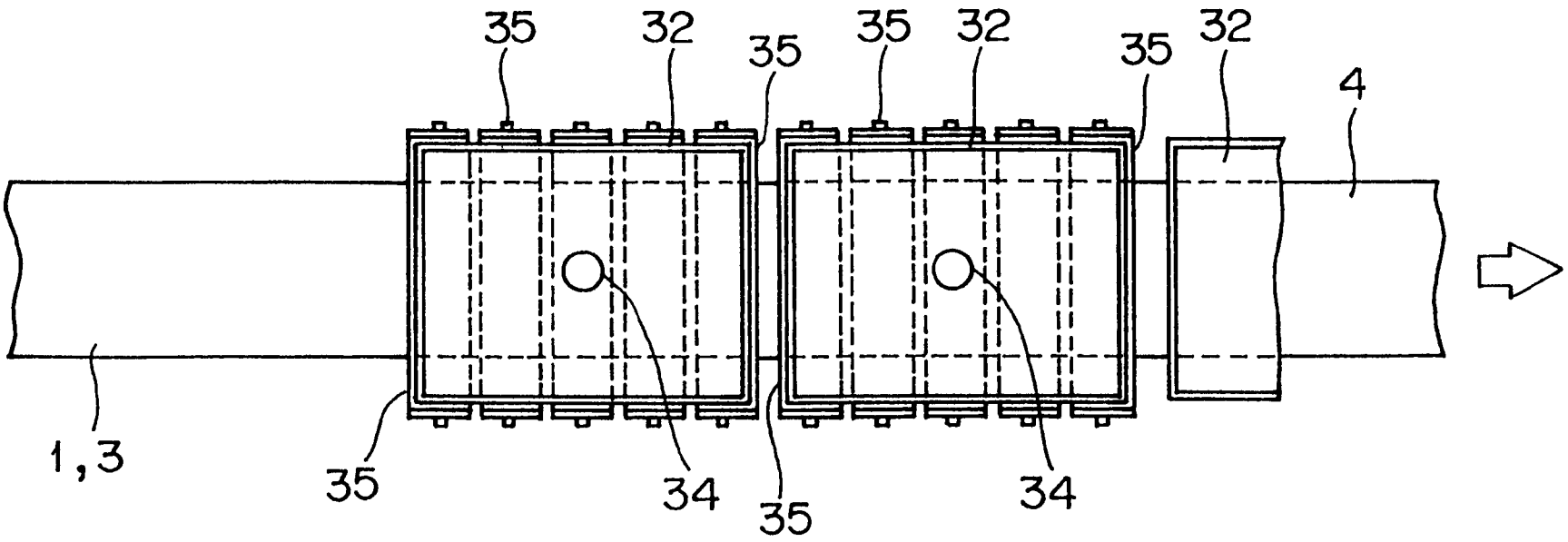
FIG. 8 is a plan view schematically showing the pressing device in the double facer in accordance with the modified example of the embodiment of the present invention.
Figure 9:
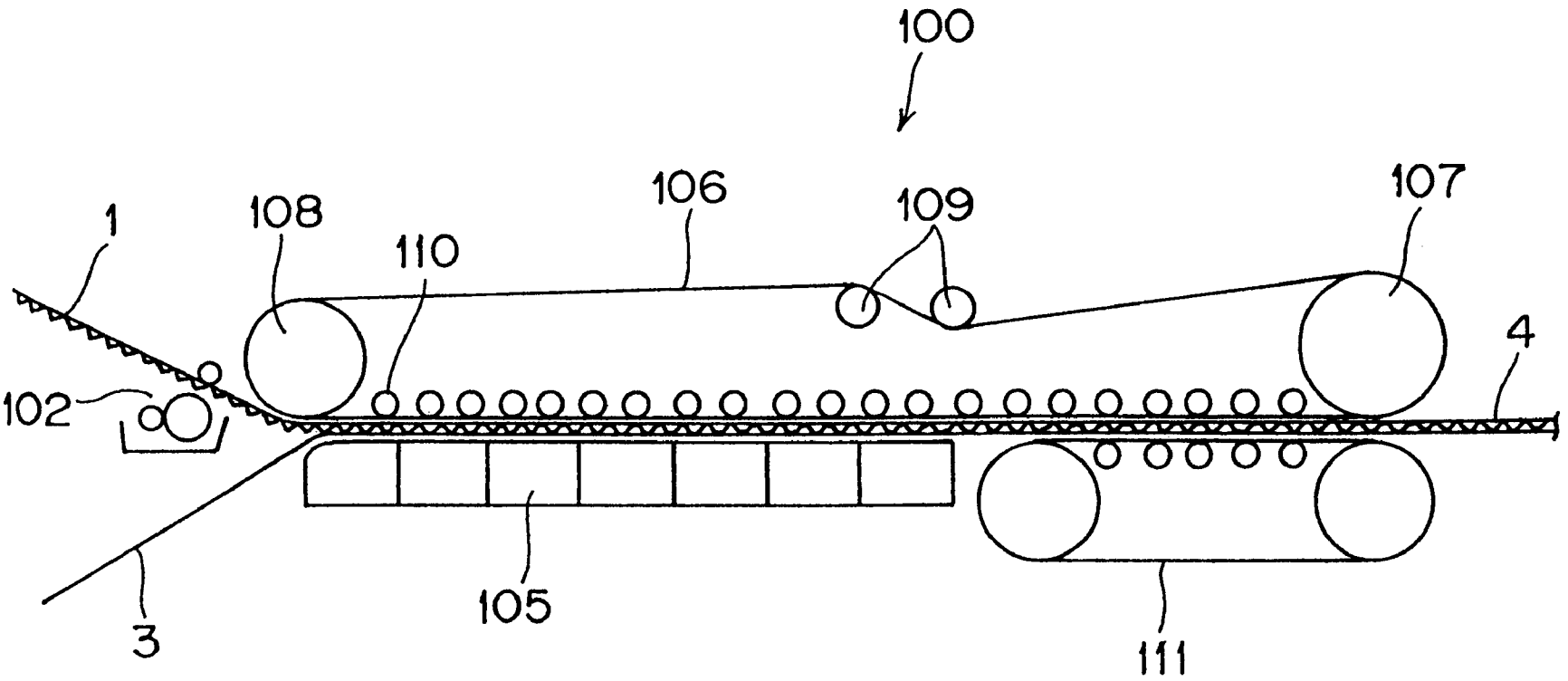
FIG. 9 is a side view schematically showing a conventional double facer.

Explained in the following is a modified example of the double facer in accordance with one embodiment of the present invention, which differs from that of the above-mentioned embodiment in terms of pressing device as shown in FIGS. 7 and 8.

Namely, as shown in FIGS. 7 and 8, a pressing device 36 of this modified example is constituted by a box-like air chamber (chamber) 32 having an open lower part, and a plurality of shape steels (planar members) 35 as pressing members densely disposed so as to close the lower opening of the air chamber 32. Into a pressure chamber 37 formed by the air chamber 32 and plurality of shape steels 35, compressed air is supplied from a blower 33 via a supply tube 34.

The plurality of shape steels 35 constituting the pressing device 36 are constituted as a plurality of kinds of shape steels having flexural rigidities different from each other. When compressed air is supplied into the air chamber 32 of the pressing device 36 from the blower 33 via the supply tube 34, thereby pressurizing the inside of the pressure chamber 37, each shape steel 35 deforms in conformity to the expanded or contracted surface form of the hot plate 5, thus making it possible to uniformly press the single-faced corrugated fiberboard sheet 1 and liner 3 on the hot plate 5 in the widthwise direction.

The other part of configuration will not be explained here since it is similar to that of the above-mentioned embodiment.

In the pressing device of the double facer in accordance with this modified example of one embodiment of the present invention, as a result of the foregoing configuration, while the single-faced corrugated fiberboard sheet 1 and liner 3 fed between the hot plate 5 and the pressing device 36 is appropriately heated by the hot plate 5, each shape steel 35 is biased downward with respect to the air chamber 32 due to the compressed air supplied to the pressure chamber 37 formed by the air chamber 32 and plurality of shape steels 35 from the blower 33 via the supply tube 34, thus applying an appropriate pressure thereto, whereby the single-faced corrugated fiberboard sheet 1 and the liner 3 are bonded together to form the corrugated fiberboard sheet 4.

In this case, the pressure caused by the dead weight of the shape steel 35 and air pressure within the air chamber 32 acts on the single-faced corrugated fiberboard sheet 1 and the liner 3, whereas the pressure onto the single-faced corrugated fiberboard sheet 1 and liner 3 can be arbitrarily adjusted when the amount of compressed air supplied into the air chamber 32, i.e., the air pressure within the air chamber 32, is regulated.

The operation of the double facer will not be explained here since it is similar to that in the above-mentioned embodiment.

Accordingly, the double facer of this modified example is advantageous in that a substantially uniform appropriate pressure can be applied to the single-faced corrugated fiberboard sheet 1 and liner 3 in the widthwise direction thereof, while the pressure can be adjusted arbitrarily, thus making it possible to make the corrugated fiberboard sheet 4 with a high quality having a high strength and a favorable flatness.

Though the sheet feeding units 40 are disposed between the pressing devices 30, 36 such that the sheet feeding units 40 alternate with the pressing devices 30, 36; as long as the single-faced corrugated fiber sheet 1 and the liner 3 can be securely fed off, it is not necessary for the sheet feeding units 40 to be disposed between all of the pressing devices 30, 36. For example, the sheet feeding units 40 may be disposed only at predetermined positions between the pressing devices 30, 36 (e.g., at every three spaces between the pressure devices) depending on the machine speed of the corrugate machine (i.e., depending on whether the corrugate machine is a high-speed machine or a low-speed machine).

Though a plurality of pressing devices 30 and 36 are disposed between the sheet feeding units 40 and 40 in this case, the numbers of pressing devices 30, 36 disposed between the sheet feeding units 40 and 40 may be either identical or different (e.g., three, three, and two successively from the upstream side in the conveying direction; or two, three, and one successively from the upstream side in the conveying direction).

Figure 11:
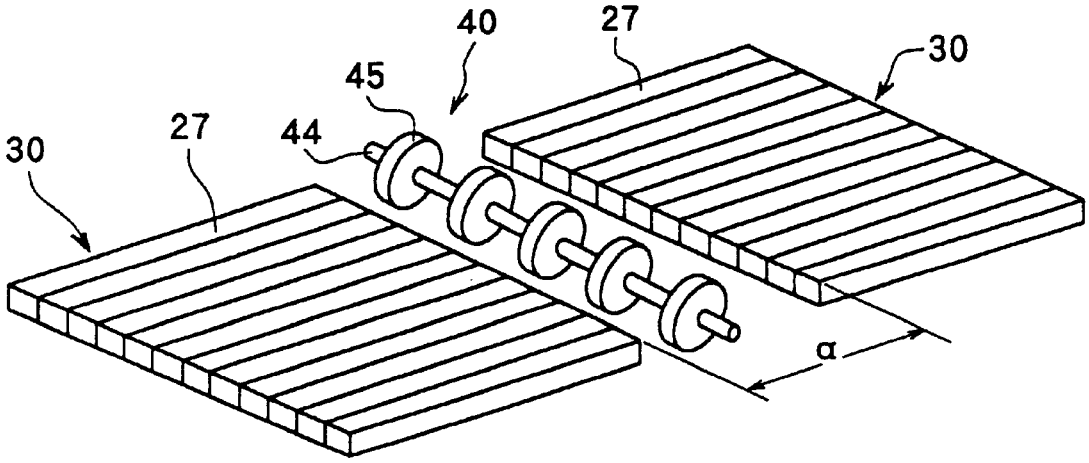
FIG. 11 is a perspective view schematically showing the pressure unit and sheet feeding unit in the double facer in accordance with the embodiment of the present invention.

Also, in this embodiment, while the pressing devices 30 are disposed as being separated from each other so as to form a predetermined space $\alpha$ therebetween as shown in FIG. 11, this space a is such that at least the moisture remaining in the single-faced corrugated fiberboard sheet 1 and the liner 3 can be released more easily as mentioned above.

Figure 12:
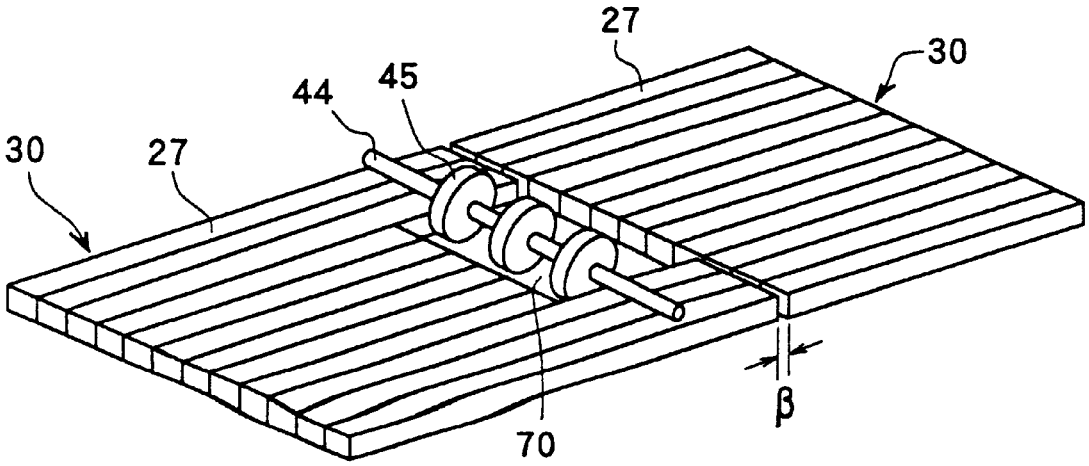
FIG. 12 is a perspective view schematically showing the pressure unit and sheet feeding unit in the double facer in accordance with a modified example of the embodiment of the present invention.

Therefore, for example, as shown in FIG. 12, the pressing devices 30 may be disposed as being separated from each other so as to form a predetermined gap β therebetween. In this case, of the weight blocks 27 constituting the pressing devices 30, a part of the weight blocks 27 are made shorter, thus forming a cutout portion 70 on one end side of the pressing device 30, and the rollers 45 of the sheet feeding unit 40 are disposed at the cutout portion 70.

Here, the weight blocks 27 corresponding to the half of the whole width of the pressing device 30 at the center portion of the pressing device 30 in the widthwise direction are made shorter, thus forming the cutout portion 70 there.

Though the cutout portion 70 is formed in each of the pressing devices 30 when the sheet feeding units 40 are disposed between the pressing devices 30 such that the sheet feeding units 40 and the pressing devices 30 alternate with each other, they should not be restricted thereto. For example, when the sheet feeding units 40 are disposed only at predetermined positions depending on the machine speed of the corrugate machine (i.e., depending on whether the corrugate machine is a high-speed machine or a low-speed machine), the cutout portions 70 may be formed at only thus disposed positions.

Though the sheet feeding units 40 are placed in the descended state only upon starting manufacture of the corrugated fiberboard sheet 4 and are raised so as not to be in contact with the single-faced corrugated fiberboard sheet 1 and the liner 3 after starting the manufacture in this embodiment; as long as a pressure sufficient for collapsing the single-faced corrugated fiberboard sheet 1 and the liner 3 is not effected by the rollers 45 of the sheet feeding units 40, the rollers 45 of the sheet feeding units 40 may be left descended, so that the rollers 45 can be rotated by the single-faced corrugated fiberboard sheet 1 and the liner 3 as they are conveyed.

Also, though the upper conveyor belt 41 and lower conveyor belt 11 are provided as a sheet conveying unit in the double facer of this embodiment, the sheet conveying unit may be constituted by a belt and a press roller or by two press rollers. Also, as the sheet conveying means, a belt-like conveyor device equipped with vacuum suction means may be disposed on the upper or lower side, such that the corrugated fiberboard sheet 4 is conveyed as being attracted by the vacuum suction means.

What is claimed is:

1. In a method of forming a corrugated fiberboard sheet by using a double facer having a heating member disposed along the conveying direction of the corrugated fiberboard sheet, a plurality of pressing devices arrayed in the conveying direction of the corrugated fiberboard sheet so that a space is interposed between at least a couple of pressing devices adjacent to each other, the plurality of pressing devices being disposed to oppose the heating member so that the pressing devices press the corrugated fiberboard sheet against the heating member, a sheet feeding unit provided in the space between the pressing devices for feeding the corrugated fiberboard sheet downstream, and a sheet conveying unit disposed downstream from the sheet feeding unit for conveying the corrugated fiberboard sheet, wherein a single-faced corrugated fiberboard sheet and a liner are conveyed and bonded together to form the corrugated fiberboard sheet, the method including an interlock of the conveying of the single-faced corrugated fiberboard sheet and the liner with the heating and bonding of the same in such a manner that:

if the corrugated fiberboard sheet does not reach the sheet conveying unit, the sheet feeding unit is brought to contact the single-faced corrugated fiberboard sheet and the liner so that the single-faced corrugated fiberboard sheet and the liner are conveyed downstream to the sheet conveying unit by the sheet feeding unit; and if the corrugated fiberboard sheet reaches the sheet conveying unit, the sheet feeding unit is brought apart from the single-faced corrugated fiberboard sheet and the liner so that the single-faced corrugated fiberboard sheet and the liner are conveyed by the sheet conveying unit while heated and bonded together by the heating member and the pressing devices.

2. A double facer for bonding a single-faced corrugated fiberboard sheet and a liner so as to form a corrugated fiberboard sheet, said double facer comprising:

a heating member disposed along a conveying direction of said corrugated fiberboard sheet;

a pressing unit, disposed to oppose said heating member, for pressing said corrugated fiberboard sheet against said heating member;

a sheet conveying unit, disposed downstream of said heating member, for conveying said corrugated fiberboard sheet toward said sheet conveying unit;

wherein said pressing unit comprises a plurality of pressing devices disposed in series as being separated from each other along the conveying direction of said corrugated fiberboard sheet, and said sheet feeding unit is interposed between said plurality of pressing devices.

3. The double facer of claim 2, wherein said corrugated fiberboard sheet includes a double-faced corrugated fiberboard sheet, a double wall corrugated fiberboard sheet, a triple wall corrugated fiberboard sheet, or a multi wall corrugated fiberboard sheet formed by a larger number of layers.

4. The double facer of claim 2, wherein said pressing unit comprises a supporting member extending in a transverse direction perpendicular to said conveying direction, a plurality of weight blocks suspended from said supporting member via an elastic member and disposed in parallel, and vertically driving means for driving said supporting member to move up and down.

5. The double facer of claim 4, wherein said plurality of weight blocks are constituted so as to directly come into contact with said single-faced corrugated fiberboard sheet or liner and press said single-faced corrugated fiberboard sheet or liner.

6. The double facer of claim 4, wherein said elastic member is constituted by a spring inserted between said supporting member and each of said weight blocks, and wherein said plurality of weight blocks are disposed in parallel in said conveying direction while each of which is formed into an elongated shape extending in said conveying direction.

7. The double facer of claim 4, wherein said pressing unit is provided with a guide section for restraining said weight blocks from moving in said conveying direction while allowing said weight blocks to move in vertical directions and tilt in said transverse direction.

8. The double facer of claim 2, wherein said pressing unit comprises a plurality of planar members disposed along the conveying direction of said corrugated fiberboard sheet, each constituted by a shape steel, and a chamber disposed so as to oppose said plurality of planar members.

9. The double facer of claim 2, wherein said heating member is constituted by a plurality of planar members heated by steam.

10. The double facer of claim 2, wherein said sheet conveying unit is constituted by an upper conveyor belt disposed on an upper side and a lower conveyor belt disposed on a lower side, and wherein said upper conveyor belt and lower conveyor belt convey said corrugated fiberboard sheet while holding said corrugated fiberboard sheet therebetween.

11. The double facer of claim 2, wherein said sheet feeding unit is constituted to be at a position in contact with said single-faced corrugated fiberboard sheet and said liner upon starting manufacture of said corrugated fiberboard sheet and at a position separated from said single-faced corrugated fiberboard sheet and said liner so as not to be in contact therewith after starting the manufacture.

12. A double facer for bonding a single-faced corrugated fiberboard sheet and a liner so as to form a corrugated fiberboard sheet, said double facer comprising:

a heating member disposed along a conveying direction of said corrugated fiberboard sheet;

a pressing unit, disposed to oppose said heating member, for pressing said corrugated fiberboard sheet against said heating member;

a sheet conveying unit, disposed downstream said heating member, for conveying said corrugated fiberboard sheet; and a sheet feeding unit for feeding said corrugated fiberboard sheet toward said sheet conveying unit;

wherein said pressing unit comprises a plurality of pressing devices disposed in series as being separated from each other along the conveying direction of said corrugated fiberboard sheet; and wherein said sheet feeding unit is disposed between said plurality of pressing devices so as to oppose said heating member.

13. The double facer for bonding a single-faced corrugated fiberboard sheet and a liner so as to form a corrugated fiberboard sheet, said double facer comprising:

a heating member disposed along a conveying direction of said corrugated fiberboard sheet;

a pressing unit, disposed to oppose said heating member, for pressing said corrugated fiberboard sheet against said heating member;

a sheet conveying unit, disposed downstream said heating member, for conveying said corrugated fiberboard sheet; and a sheet feeding unit for feeding said corrugated fiberboard sheet toward said sheet conveying unit;

wherein said pressing unit comprises a plurality of pressing devices disposed in series as being separated from each other along the conveying direction of said corrugated fiberboard sheet; and wherein said sheet feeding unit comprises:

a roller, firmly supported by a rotary shaft driven to rotate, for feeding said single-faced corrugated fiberboard sheet and said liner, and height position adjusting means for adjusting height positions of said rotary shaft and roller;

wherein said rotary shaft is placed at a position in contact with said single-faced corrugated fiberboard sheet and said liner upon starting manufacture of said corrugated fiberboard sheet, whereas said rotary shaft is placed at a position separated from said single-faced corrugated fiberboard sheet and said liner so as not to be in contact therewith after manufacture of said corrugated fiberboard sheet is started.

14. The double facer of claim 13, wherein said height position adjusting means comprises:

an arm for rotatably supporting said rotary shaft, an axis for firmly supporting said arm, and a lever secured to an end portion of said axis so as to be rotated together with said axis; and wherein said lever is rotated such that said rotary shaft supported by said arm is placed at a position in contact with said single-faced corrugated fiberboard sheet and said liner upon starting manufacture of said corrugated fiberboard sheet, whereas said lever is rotated such that said rotary shaft supported by said arm is placed at a position separated from said single-faced corrugated fiberboard sheet and said liner so as not to be in contact therewith after manufacture of said corrugated fiberboard sheet is started.

15. The double facer of claim 14, wherein said lever has an upper protruded part and a lower protruded part, said lever comprising:

an air cylinder, adapted to abut to said upper protruded part, for rotating said lever in one direction, and an elastic member, attached to said lower protruded part, for rotating said lever in an opposite direction; and wherein said air cylinder is caused to abut to said upper protruded part so as to rotate said lever in said one direction such that said rotary shaft supported by said arm is placed at a position in contact with said single-faced corrugated fiberboard sheet and said liner upon starting manufacture of said corrugated fiberboard sheet, whereas said elastic member causes said lever to rotate in the opposite direction such that said rotary shaft supported by said arm is placed at a position separated from said single-faced corrugated fiberboard sheet and said liner so as not to be in contact therewith after manufacture of said corrugated fiberboard sheet is started.

16. A double facer in which a single faced corrugated fiberboard sheet and a liner are conveyed and bonded together to form a corrugated fiberboard sheet, comprising:

a heating member disposed along the conveying direction of the corrugated fiberboard sheet;

a plurality of pressing devices arrayed so that a space is interposed between at least a couple of pressing devices adjacent to each other, the plurality of pressing devices being disposed to oppose the heating member so that the pressing devices press the corrugated fiberboard sheet against the heating member;

a sheet feeding unit provided in the space between the pressing devices for feeding the corrugated fiberboard sheet downstream; and a sheet conveying unit disposed downstream from the sheet feeding unit for conveying the corrugated fiberboard sheet.

17. A double facer for bonding a single-faced corrugated fiberboard sheet and a liner so as to form a corrugated fiberboard sheet, said double facer comprising:

a heating member disposed along a conveying direction of said corrugated fiberboard sheet;

a pressing unit, disposed to oppose said heating member, for pressing said corrugated fiberboard sheet against said heating member;

a sheet conveying unit, disposed downstream said heating member, for conveying said corrugated fiberboard sheet; and a sheet feeding unit for feeding said corrugated fiberboard sheet toward said sheet conveying unit;

wherein said pressing unit comprises a plurality of pressing devices disposed in series as being separated from each other along the conveying direction of said corrugated fiberboard sheet;

wherein said pressing unit comprises a supporting member extending in a transverse direction perpendicular to said conveying direction, a plurality of weight blocks suspended from said supporting member via an elastic member and disposed in parallel, and vertically driving means for driving said supporting member to move up and down;

wherein said elastic member is constituted by a spring inserted between said supporting member and each of said weight blocks, and said plurality of weight blocks are disposed in parallel in said conveying direction while each of which is formed into an elongated shape extending in said conveying direction;

wherein said plurality of pressing devices are disposed with a gap therebetween;

wherein said pressing devices comprise a cutout portion which is formed by a part of said plurality of weight blocks having a smaller length; and wherein said sheet feeding unit is disposed at said cutout portion.

* * * * *